US009809872B2

(12) United States Patent
Aoyama et al.

(10) Patent No.: US 9,809,872 B2
(45) **Date of Patent: *Nov. 7, 2017**

(54) DILUTE COPPER ALLOY MATERIAL, DILUTE COPPER ALLOY WIRE, DILUTE COPPER ALLOY TWISTED WIRE AND CABLE USING THE SAME, COAXIAL CABLE AND COMPOSITE CABLE, AND METHOD OF MANUFACTURING DILUTE COPPER ALLOY MATERIAL AND DILUTE COPPER ALLOY WIRE

(75) Inventors: Seigi Aoyama, Kitaibaraki (JP); Toru Sumi, Hitachi (JP); Shuji Sakai, Tsuchiura (JP); Takahiro Sato, Hitachi (JP); Hidenori Abe, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 1186 days.

This patent is subject to a terminal disclaimer.

(21) Appl. No.: 12/756,551

(22) Filed: Apr. 8, 2010

(65) Prior Publication Data

US 2010/0263905 A1 Oct. 21, 2010

(30) Foreign Application Priority Data

Apr. 17, 2009 (JP) ..... 2009-101360
May 14, 2009 (JP) ..... 2009-117920

(51) Int. Cl.
*C22C 9/00* (2006.01)
*B22D 11/00* (2006.01)
(Continued)

(52) U.S. Cl.
CPC ..... *C22C 9/00* (2013.01); *B22D 21/025* (2013.01); *C22F 1/08* (2013.01); *H01B 1/026* (2013.01)

(58) Field of Classification Search
CPC ..... C22C 9/00; B22D 21/025; B22D 11/004; H01B 1/026; C22F 1/08
(Continued)

(56) References Cited

U.S. PATENT DOCUMENTS 2,622,152 A 12/1952 Rosch
3,143,789 A 8/1964 Iler et al.
(Continued)

FOREIGN PATENT DOCUMENTS

CN 1384216 A 12/2002
CN 101864530 A 10/2010
(Continued)

OTHER PUBLICATIONS

D.E. Tyler and W.T. Black, Introduction to Copper and Copper Alloys, Properties and Selection: Nonferrous Alloys and Special-Purpose Materials, vol. 2, ASM Handbook, ASM International, 1990, p. 216-240. (Provided only Electrical Coppers section and Figures 1-4).*
(Continued)

*Primary Examiner* — Keith Walker
*Assistant Examiner* — John Hevey
(74) *Attorney, Agent, or Firm* — Foley & Lardner LLP

(57) ABSTRACT

A dilute copper alloy material includes, based on a total mass of the dilute copper alloy material, 2 to 12 mass ppm of sulfur, 2 to 30 mass ppm of oxygen, 4 to 55 mass ppm of titanium, and a balance of pure copper and inevitable impurity. A part of the sulfur and the titanium forms a compound or an aggregate of TiO, $TiO_2$, TiS or Ti—O—S, and an other part of the sulfur and the titanium forms a solid solution. TiO, $TiO_2$, TiS and Ti—O—S distributed in a crystal grain of the dilute copper alloy material are not more than 200 nm, not more than 1000 nm, not more than 200 nm and not more than 300 nm, respectively, in particle size
(Continued)

thereof, and not less than 90% of particles distributed in a crystal grain of the dilute copper alloy material are 500 nm or less in particle size.

16 Claims, 3 Drawing Sheets

(51) Int. Cl.
*H01B 1/02* (2006.01)
*C22F 1/08* (2006.01)
*B22D 21/02* (2006.01)

(58) Field of Classification Search
USPC ..... 148/432–436; 420/492, 500; 174/68.1, 174/251, 71 C, 102 R, 106 R
See application file for complete search history.

(56) References Cited

U.S. PATENT DOCUMENTS

| | | | | |
|---|---|---|---|---|
| 3,450,928 | A | 6/1969 | Cobine | |
| 3,776,719 | A | 12/1973 | Foldes | |
| 4,389,250 | A | 6/1983 | Melton et al. | |
| 4,567,321 | A | 1/1986 | Harayama | |
| 4,726,859 | A | 2/1988 | Hosoda et al. | |
| 4,786,469 | A | 11/1988 | Weber et al. | |
| 4,863,804 | A | 9/1989 | Whitlow et al. | |
| 5,077,005 | A * | 12/1991 | Kato | 420/469 |
| 5,565,045 | A | 10/1996 | Caron et al. | |
| 5,843,243 | A | 12/1998 | Kawasaki et al. | |
| 6,022,426 | A | 2/2000 | Mennucci et al. | |
| 6,077,364 | A | 6/2000 | Chandler et al. | |
| 6,093,886 | A | 7/2000 | Bazizi et al. | |
| 6,103,188 | A | 8/2000 | Guixa Arderiu et al. | |
| 6,197,433 | B1 | 3/2001 | Hatano | |
| 6,627,009 | B1 | 9/2003 | Matsui et al. | |
| 6,677,518 | B2 | 1/2004 | Hirakawa et al. | |
| 6,682,824 | B1 | 1/2004 | Koshiba et al. | |
| 6,894,226 | B2 * | 5/2005 | Yokoi | H01B 11/183 174/102 R |
| 7,244,286 | B2 | 7/2007 | Matsuki | |
| 7,482,540 | B2 | 1/2009 | Shukushima et al. | |
| 8,004,094 | B2 | 8/2011 | Uno et al. | |
| 8,779,294 | B2 * | 7/2014 | Sumi | H01B 1/026 148/432 |
| 8,835,766 | B2 * | 9/2014 | Aoyama | H01B 1/026 174/113 R |
| 9,234,263 | B2 * | 1/2016 | Kuroda | C22C 1/02 |
| 9,293,231 | B2 * | 3/2016 | Aoyama | H01B 1/026 |
| 2001/0028135 | A1 | 10/2001 | Asao et al. | |
| 2001/0029659 | A1 | 10/2001 | Asao et al. | |
| 2002/0157741 | A1 | 10/2002 | Yamamoto et al. | |
| 2005/0161129 | A1 | 7/2005 | Aoyama et al. | |
| 2005/0262968 | A1 | 12/2005 | Asao et al. | |
| 2006/0157167 | A1 * | 7/2006 | Kuroda | C22C 9/02 148/554 |
| 2007/0015001 | A1 | 1/2007 | Uno et al. | |
| 2008/0283159 | A1 | 11/2008 | Aoyama et al. | |
| 2010/0163139 | A1 | 7/2010 | Aoyama et al. | |
| 2010/0230069 | A1 | 9/2010 | Aoyama et al. | |
| 2010/0263905 | A1 | 10/2010 | Aoyama et al. | |
| 2012/0097420 | A1 | 4/2012 | Aoyama et al. | |
| 2012/0097422 | A1 | 4/2012 | Sumi et al. | |
| 2012/0097904 | A1 | 4/2012 | Kuroda et al. | |
| 2012/0100390 | A1 | 4/2012 | Kuroda et al. | |
| 2012/0305286 | A1 | 12/2012 | Aoyama et al. | |
| 2012/0325517 | A1 | 12/2012 | Uzoh et al. | |
| 2013/0022831 | A1 | 1/2013 | Sagawa et al. | |
| 2013/0042949 | A1 | 2/2013 | Sagawa et al. | |
| 2014/0000932 | A1 * | 1/2014 | Aoyama | H01B 1/026 174/105 R |

FOREIGN PATENT DOCUMENTS

| | | | |
|---|---|---|---|
| JP | 54063284 | A * | 5/1979 |
| JP | 61-224443 | A | 10/1986 |
| JP | 63-061703 | A | 3/1988 |
| JP | 63-109130 | A | 5/1988 |
| JP | 63-206441 | A | 8/1988 |
| JP | 64-11931 | A | 1/1989 |
| JP | 1-198457 | | 8/1989 |
| JP | 1-264110 | A | 10/1989 |
| JP | 2-104629 | A | 4/1990 |
| JP | 2-163330 | A | 6/1990 |
| JP | 6-179932 | A | 6/1994 |
| JP | 9-157775 | A | 6/1997 |
| JP | 9-256084 | A | 9/1997 |
| JP | 2737954 | B2 | 4/1998 |
| JP | 2737965 | B2 | 4/1998 |
| JP | 11-111070 | A | 4/1999 |
| JP | 3050554 | B2 | 6/2000 |
| JP | 2000-212660 | A | 8/2000 |
| JP | 2001-314950 | A | 11/2001 |
| JP | 2002-120050 | A | 4/2002 |
| JP | 2002-294369 | A | 10/2002 |
| JP | 2002-363668 | A | 12/2002 |
| JP | 3552043 | B2 | 8/2004 |
| JP | 3651386 | B2 | 5/2005 |
| JP | 2006-274383 | A | 10/2006 |
| JP | 2006-274384 | A | 10/2006 |
| JP | 2008-1933 | A | 1/2008 |
| JP | 2008-41447 | A | 2/2008 |
| JP | 2008-084874 | A | 10/2008 |
| JP | 2008-255417 | A | 10/2008 |
| JP | 2010-265511 | A | 11/2010 |
| JP | 2011-179110 | A | 9/2011 |
| JP | 2012-089359 | A | 5/2012 |

OTHER PUBLICATIONS

Engineering Data for Metals and Alloys, Metals handbook/edited by J.R. Davis; prepared under the direction of the ASM International Handbook Committee.—Desk ed.; Published in 1998.*

Hisashi Suzuki et al., Increase of Recrystallization Rate of Pure Copper by the Trace Addition of Ti, Zr or V, The Iron and Steel Institute of Japan, 1984, pp, 187-193, No. 15.

USPTO Office Action, U.S. Appl. No. 13/553,762, Dec. 18, 2012, 16 pages.

Hisashi Suzuki et al., Increase of Recrystallization Rate of Pure Copper by the Trace Addition of Ti, Zr or V, The Iron and Steel Institute of Japan (ISIJ), No. 15, 1984, pp. 1977-1983 and partial translation, 2 pages.

USPTO Office Action, U.S. Appl. No. 13/317,461, Sep. 25, 2012, 11 pages.

USPTO Office Action, U.S. Appl. No. 13/317,461, Mar. 13, 2013, 8 pages.

USPTO Office Action, U.S. Appl. No. 13/577,400, Dec. 21, 2012, 13 pages.

USPTO Office Action, U.S. Appl. No. 13/317,463, Sep. 30, 2013, 13 pages.

Aoyama et al., Effects of Hot-Working Processes and Impurities on the Properties of Cold-Drawn Cu Wires, Journal of the Japan Institute of Metals, vol. 51, No. 9 (1987), pp. 858-863 (with partial English translation).

Chinese Office Action dated Jun. 3, 2015 with partial English translation.

Japanese Submission of Information on Publications, dated May 7, 2013 with English translation.

International Search Report in PCT/JP2012/056852 dated Jun. 19, 2012 (English Translation Thereof).

USPTO Notice of Allowance, U.S. Appl. No. 13/317,462, Apr. 17, 2014, 7 pages.

USPTO Notice of Allowance, U.S. Appl. No. 13/317,463, Sep. 10, 2015, 13 pages.

USPTO Office Action, U.S. Appl. No. 13/317,461, Feb. 28, 2017, 24 pages.

(56) References Cited

OTHER PUBLICATIONS

USPTO Office Action, U.S. Appl. No. 13/317,461, May 1, 2014, 14 pages.
USPTO Office Action, U.S. Appl. No. 13/317,461, May 19, 2015, 20 pages.
USPTO Office Action, U.S. Appl. No. 13/317,461, Oct. 8, 2013, 15 pages.
USPTO Office Action, U.S. Appl. No. 13/317,461, Nov. 5, 2015, 23 pages.
USPTO Office Action, U.S. Appl. No. 13/317,462, Oct. 28, 2013, 13 pages.
USPTO Office Action, U.S. Appl. No. 13/317,463, Jan. 26, 2015, 13 pages.
USPTO Office Action, U.S. Appl. No. 13/317,463, Apr. 21, 2014, 17 pages.
USPTO Office Action, U.S. Appl. No. 13/317,463, Apr. 30, 2015, 12 pages.
USPTO Office Action, U.S. Appl. No. 13/317,463, Aug. 28, 2014, 15 pages.
USPTO Office Action, U.S. Appl. No. 13/553,762, Apr. 7, 2015, 30 pages.
USPTO Office Action, U.S. Appl. No. 13/553,762, Jun. 5, 2013, 16 pages.
USPTO Office Action, U.S. Appl. No. 13/553,762, Sep. 25, 2015, 23 pages.
USPTO Office Action, U.S. Appl. No. 13/577,400, Apr. 22, 2015, 10 pages.
USPTO Office Action, U.S. Appl. No. 13/577,400, Aug. 13, 2013, 22 pages.
USPTO Office Action, U.S. Appl. No. 13/577,400, Sep. 28, 2015, 21 pages.
USPTO Office Action, U.S. Appl. No. 13/577,400, Oct. 4, 2016, 9 pages.
USPTO Office Action, U.S. Appl. No. 14/075,285, Feb. 10, 2015, 15 pages.
USPTO Office Action, U.S. Appl. No. 14/328,958, Jul. 16, 2015, 17 pages.
USPTO Office Action,U.S. Appl. No. 13/553,762, Feb. 24, 2017, 16 pages.
Japanese Office Action with English translation, Feb. 25, 2014, 10 pages.
USPTO Notice of Allowance, U.S. Appl. No. 13/317,461, dated Jun. 28, 2017, 15 pages.

* cited by examiner

DILUTE COPPER ALLOY MATERIAL, DILUTE COPPER ALLOY WIRE, DILUTE COPPER ALLOY TWISTED WIRE AND CABLE USING THE SAME, COAXIAL CABLE AND COMPOSITE CABLE, AND METHOD OF MANUFACTURING DILUTE COPPER ALLOY MATERIAL AND DILUTE COPPER ALLOY WIRE

The present application is based on Japanese Patent Application No. 2009-101360 filed on Apr. 17, 2009 and Japanese Patent Application No. 2009-117920 filed on May 14, 2009, the entire contents of which are incorporated herein by reference.

BACKGROUND OF THE INVENTION

1. Field of the Invention

The invention relates to a dilute copper alloy material which has high productivity and is excellent in conductivity, softening temperature and surface quality, a dilute copper alloy wire, a dilute copper alloy twisted wire and a cable using the same, a coaxial cable and a composite cable, and a method of manufacturing the dilute copper alloy material and the dilute copper alloy wire.

2. Description of the Related Art

In recent industrial products such as electronic devices and vehicles, a copper wire is often used harshly. In order to address these needs, a dilute copper alloy material which can be manufactured by a continuous casting and rolling method, etc., and has productivity higher than that of pure copper while maintaining conductivity and elongation characteristics to a pure copper level has been being developed.

A dilute copper alloy material is demanded to be a soft conductor having conductivity of 98% or more, or further, 102% or more as a general purpose soft copper wire or a copper material to which the softness is required, and the intended purpose thereof includes a cabling material for consumer solar cell, an enameled wire conductor for motor, a high-temperature application soft copper material used at from 200° C. to 700° C., a molten solder plating material not requiring annealing, a copper material excellent in thermal conductivity and a material alternative to high purity copper, which addresses a wide range of these needs.

A technique of controlling oxygen in copper to 10 mass ppm or less is applied to a base in the raw material as the dilute copper alloy material, and it is expected to obtain a dilute copper alloy material having high productivity and excellent in conductivity, softening temperature and surface quality by adding a small amount of metal such as Ti to copper atoms in the base, and then, melting and solidifying in the form of atom.

As described in a of "Iron and Steel" by Hisashi Suzuki and Mikihiro Sugano (1984), No. 15, 1977-1983 regarding conventional softening, the result has been obtained in which the softening of a sample in which 4-28 mol ppm of Ti is added to electrolyte copper (99.996 mass % or more) occurs earlier than a sample without addition. The non-patent literary document has concluded that this is caused by a decrease in solid solubility S due to formation of sulfide of Ti.

JP-B-3050554, JP-B-2737954 and JP-B-2737965 have proposed to continuously casting in a continuous casting apparatus using a dilute copper alloy in which a small amount of Ti is added to oxygen-free copper, which have been already patented.

Here, a method of reducing oxygen by a continuous casting and rolling method is also known as described JP-B-3552043 and JP-B-3651386.

JP-A-2006-274384 proposes that, when a copper material is manufactured directly from molten copper (or copper melt) by the continuous casting and rolling method, the softening temperature is lowered by adding a small amount of metal such as Ti, Zr or V (0.0007-0.005 mass %) to the molten copper with an oxygen amount of 0.005 mass % or less. However, in JP-A-2006-274384, conductivity is not examined and a range of manufacturing conditions for achieving both of the conductivity and the softening temperature is unclear.

On the other hand, JP-A-2008-255417 proposes a method of manufacturing an oxygen-free copper material having a low softening temperature and high conductivity, in which a copper material is manufactured by a drawing-up continuous casting apparatus using molten copper in which a small amount of metal such as Ti, Zr or V (0.0007-0.005 mass %) is added to the oxygen-free copper with an oxygen amount of 0.0001 mass %.

However, a material including a small amount of oxygen, i.e., including oxygen at a concentration of ppm order similarly to the dilute copper alloy material as described above, is not examined in any patent documents as well as the non-patent literary document.

Therefore, a practical dilute copper alloy wire having high productivity and excellent in conductivity, softening temperature and surface quality as well as a composition thereof have been desired to be examined.

In addition, as for the examination of the manufacturing method, a method of softening copper by adding Ti to oxygen-free copper by continuous casting is known as described above, in which a wire rod is made by hot extrusion or hot rolling after manufacturing a casting material as cake or billet. Thus, the manufacturing cost is high and there is a problem of economic efficiency for industrial use.

In addition, although a method of adding Ti to oxygen-free copper by the drawing-up continuous casting apparatus is known, there is also a problem of economic efficiency due to the slow production rate.

Then, a method using a SCR continuous casting and rolling system (South Continuous Rod System) is examined.

In a SCR continuous casting and rolling method, molten metal is formed by melting a base material in a melting furnace of the SCR continuous casting and rolling apparatus, desired metal is added to and melted in the molten metal, a roughly drawn wire (e.g., 8 mm in diameter) is made of the molten metal, and the roughly drawn wire is drawn to be, e.g., 2.6 mm in diameter by hot rolling. Also, it is possible to be processed into a wire with a diameter of 2.6 mm or less, or a plate material or a deformed material in the same way. In addition, it is effective to roll a round wire rod into a rectangular or contour strip. Alternatively, it is possible to make a deformed material by conform extrusion of casting material.

As a result of the examination by inventors, etc., it is found that a surface flaw is likely to be generated in tough pitch copper as a base material when the SCR continuous casting and rolling is used, and variation of softening temperature and a status of titanium oxide formation are unstable depending on conditions for addition.

In addition, when examined using oxygen-free copper of 0.0001 mass % or less, the conditions which satisfy the softening temperature, the conductivity and the surface quality are in a very narrow range. Furthermore, there is a limit to decrease the softening temperature, thus, the further lower softening temperature which is equivalent to that of high purity copper is desired.

SUMMARY OF THE INVENTION

Therefore, it is an object of the invention to provide a dilute copper alloy material that has high productivity and is excellent in conductivity, softening temperature and surface quality, as well as a method of manufacturing the same.

(1) According to one embodiment of the invention, a dilute copper alloy material comprises:

based on a total mass of said dilute copper alloy material, 2 to 12 mass ppm of sulfur, 2 to 30 mass ppm of oxygen, 4 to 55 mass ppm of titanium, and a balance consisting of pure copper and an inevitable impurity.

In the above embodiment (1), the following modifications and changes can be made.

(i) A part of the sulfur and the titanium forms a compound or an aggregate of TiO, $TiO_2$, TiS or Ti—O—S, and an other part of the sulfur and the titanium forms a solid solution.

(ii) The TiO, $TiO_2$, TiS and Ti—O—S distributed in a crystal grain of the dilute copper alloy material are not more than 200 nm, not more than 1000 nm, not more than 200 nm and not more than 300 nm, respectively, in particle size thereof, and not less than 90% of particles distributed in a crystal grain of the dilute copper alloy material are not more than 500 nm or less in particle size.

(2) According to another embodiment of the invention, a dilute copper alloy wire comprises:

the dilute copper alloy material according to the embodiment (1);

a conductivity not less than 98% IACS; and a softening temperature of 130° C. to 148° C. when a diameter thereof is 2.6 mm.

(3) According to another embodiment of the invention, a dilute copper alloy wire comprises:

a dilute copper alloy material comprising, based on a total mass of said dilute copper alloy material, 2 to 12 mass ppm of sulfur, 2 to 30 mass ppm of oxygen, 4 to 37 mass ppm of titanium, and a balance consisting of pure copper and an inevitable impurity;

a conductivity not less than 100% IACS; and a softening temperature of 130° C. to 148° C. when a diameter thereof is 2.6 mm.

(4) According to another embodiment of the invention, a dilute copper alloy wire comprises:

a dilute copper alloy material comprising, based on a total mass of said dilute copper alloy material, 2 to 12 mass ppm of sulfur, 2 to 30 mass ppm of oxygen, 4 to 25 mass ppm of titanium, and a balance consisting of pure copper and an inevitable impurity;

a conductivity not less than 102% IACS; and a softening temperature of 130° C. to 148° C. when a diameter thereof is 2.6 mm.

In the above embodiments (2) to (4), the following modifications and changes can be made.

(iii) The dilute copper alloy wire further comprises a plating layer formed on a surface of the dilute copper alloy wire.

(5) According to another embodiment of the invention, a dilute copper alloy twisted wire comprises:

a plurality of the dilute copper alloy wires according to the embodiments (2) to (4) twisted together.

(6) According to another embodiment of the invention, a cable comprises:

the dilute copper alloy wire according to according to the embodiments (2) to (4), and an insulating layer formed on the dilute copper alloy wire.

(7) According to another embodiment of the invention, a coaxial cable comprises:

a central conductor comprising a plurality of the dilute copper alloy wires according to the embodiments (2) to (4) twisted together;

an insulation cover on an outer periphery of the central conductor;

an outer conductor comprising copper or copper alloy on an outer periphery of the insulation cover; and a jacket layer on an outer periphery of the outer conductor.

(8) According to another embodiment of the invention, a composite cable comprises:

a plurality of the cables according to the embodiment (6) or the coaxial cables according to the embodiment (7) arranged in a shield layer; and a sheath on an outer periphery of the shield layer.

(9) According to another embodiment of the invention, a method of manufacturing a dilute copper alloy wire comprises:

forming molten metal by melting the dilute copper alloy material according to claim 1 by SCR continuous casting and rolling at a casting temperature of not less than 1100° C. and not more than 1320° C.;

making a wire rod at a working ratio of 90% (corresponding to 30 mm in diameter) to 99.8% (corresponding to 5 mm in diameter); and making a dilute copper alloy wire by hot-rolling the wire rod.

In the above embodiment (9), the following modifications and changes can be made.

(iv) The hot-rolling is conducted such that temperature is not more than 880° C. at an initial roll and not less than 550° C. at a final roll.

(v) Copper as a base of the dilute copper alloy material is molten in a shaft furnace, and is subsequently cast and rolled under a reducing system comprising reductive gas atmosphere shield while controlling concentrations of sulfur, titanium and oxygen in the dilute copper alloy material.

(10) According to another embodiment of the invention, a method of manufacturing a dilute copper alloy member comprises:

forming a wire rod from the dilute copper alloy material according to claim 1 by twin-roll continuous casting and rolling and Properzi type continuous casting and rolling at a casting temperature of not less than 1100° C. nor more than 1320° C.; and hot-rolling the wire rod, wherein said hot-rolling is conducted such that temperature is not more than 880° C. at an initial roll and not less than 550° C. at a final roll.

In the above embodiment (10), the following modifications and changes can be made.

(vi) Copper as a base of the dilute copper alloy member is molten in a shaft furnace, and is subsequently cast and rolled under a reducing system comprising a gutter in a reduced-state and a reductive gas atmosphere shield while controlling concentrations of sulfur, titanium and oxygen in the dilute copper alloy material.

(11) According to another embodiment of the invention, a solder-plated composite wire for a solar cell manufactured by using the dilute copper alloy wire according to the embodiments (2) to (4).

Points of the Invention

According to one embodiment of the invention, two measures are combined in order to lower the softening temperature as well as to improve the conductivity. As one measure, the oxygen concentration of a raw material is increased to 2 mass ppm or more and titanium is added thereto. Thereby, TiS, titanium oxide ($TiO_2$) or Ti—O—S particle is initially formed in molten copper. As the other measure, the hot rolling temperature (i.e., 880 to 550° C.) is set to be lower than the typical manufacturing conditions (i.e., 950 to 600° C.) of copper so that dislocation is introduced into copper to allow easy precipitation of sulfur. As a result, S is precipitated on the dislocation or is precipitated using titanium oxide ($TiO_2$) as crystal nuclei. Thus, sulfur in the copper is sufficiently crystallized or precipitated so that a copper wire rod with decreased softening temperature and improved conductivity can be formed after a cold wire drawing process.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

A preferred embodiment of the invention will be described in detail below.

To begin with, the invention is to obtain a dilute copper alloy material as a soft copper material in which a SCR continuous casting equipment is used, there are few surface flaws, a manufacturing range is wide, stable manufacturing is possible, and a softening temperature of 148° C. or less and conductivity of 98% IACS (International Annealed Copper Standard), conductivity is defined as 100% when resistivity is $1.7241\times10^{-8}$ Ω/km), or further, 102% IACS at a working ratio of 90% (e.g., from 8 mm into 2.6 mm in diameter) are satisfied, and to obtain the manufacturing method thereof at the same time.

At this time, the softening temperature at the working ratio of 90% is 130° C. for Cu (at a purity of 6N, i.e., 99.9999%). Therefore, it is a subject of the invention to find a raw material as a dilute copper alloy material which allows stable manufacturing of soft copper of which softening temperature is not less than 130° C. nor more than 148° C., the conductivity of the soft material is 98% IACS or more, or 100% IACS or more, or further, 102% IACS or more, and to seek the manufacturing conditions thereof.

Here, where an 8 mm diameter wire rod is manufactured from molten metal having several mass ppm of titanium added thereto in an experimental laboratory by a small continuous casting machine using Cu (at a purity of 4N) with an oxygen concentration of 1 to 2 mass ppm and then drawn to have a 2.6 mm diameter (at a working ratio of 90%), the measured softening temperature is 160 to 168° C. and cannot be lower than this temperature. Also, the conductivity is about 101.7% IACS. Thus, it was found that, even though the oxygen concentration is reduced and Ti is added, it is not possible to lower the softening temperature, and the conductivity is inferior to that of Cu (at a purity of 6N) which is 102.8% IACS.

It is presumed that the softening temperature is not lowered because several mass ppm or more of sulfur is included as inevitable impurity when the molten metal is manufactured and sulfide of TiS, etc., is not sufficiently formed by sulfur and titanium.

Then, two measures were employed and two effects were combined in order to lower the softening temperature and to improve the conductivity, and the invention thereby achieved the subject.

Figure 1:
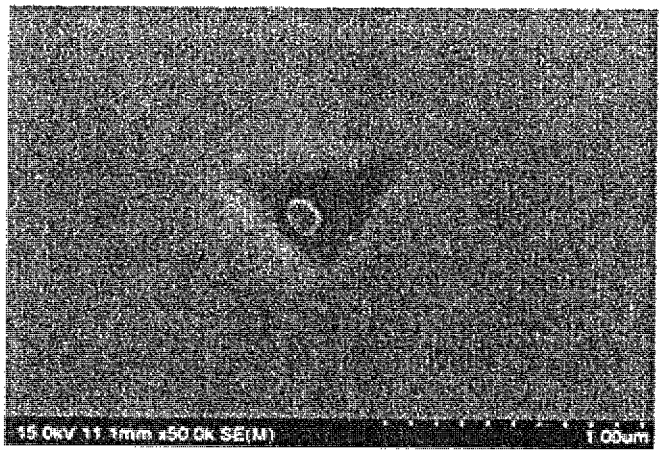
FIG. 1 is a view showing a SEM image of TiS particle.
Figure 2:
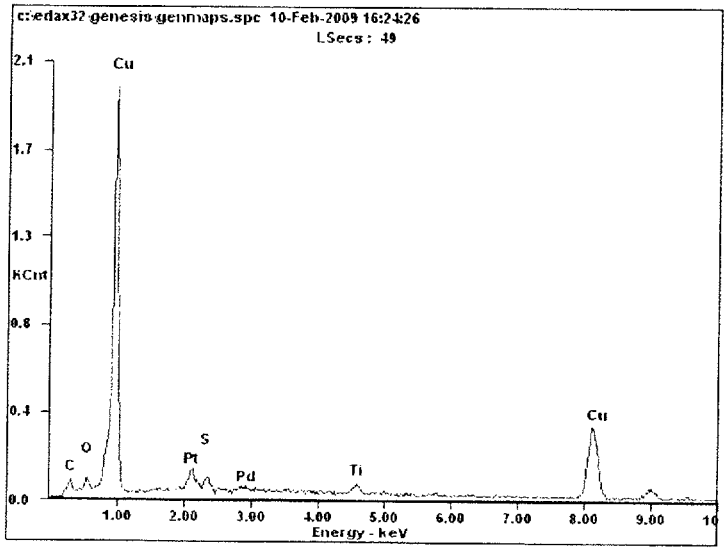
FIG. 2 is a view showing a result of analysis of FIG. 1.
Figure 3:
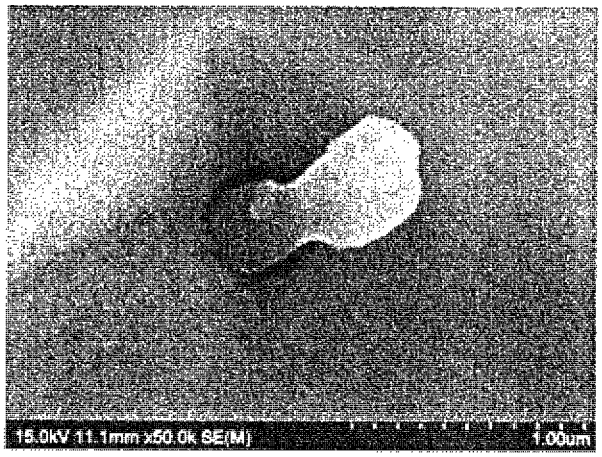
FIG. 3 is a view showing a SEM image of $TiO_2$ particle.
Figure 4:
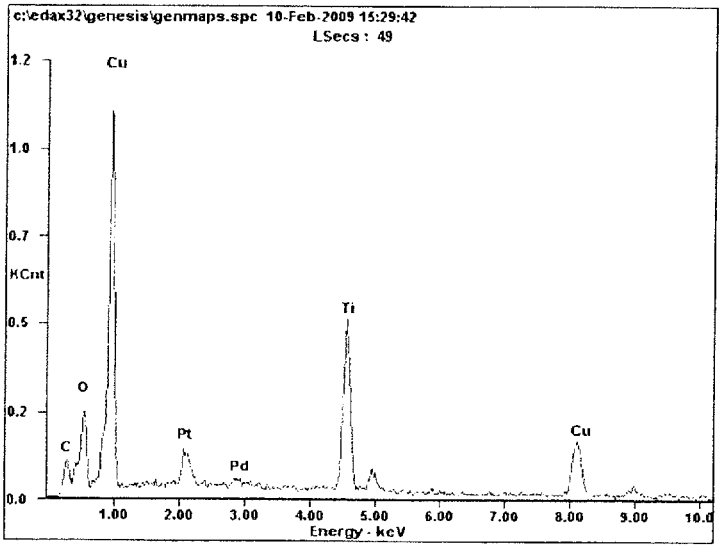
FIG. 4 is a view showing a result of analysis of FIG. 3.
Figure 6:
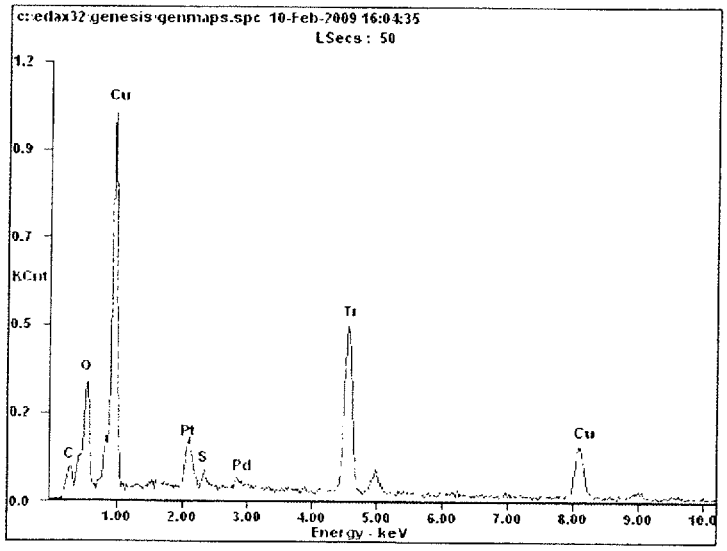
FIG. 6 is a view showing a result of analysis of FIG. 5.

(a) The oxygen concentration of the raw material is increased to 2 mass ppm or more, and then, titanium is added thereto. From the above, it is considered that the TiS, titanium oxide ($TiO_2$) or Ti—O—S particle is initially formed in molten copper (See the SEM images of FIGS. 1 and 3 and the results of analysis of FIGS. 2 and 4). It should be noted that Pt and Pd in FIGS. 2, 4 and 6 are vapor deposition elements used for the purpose of observation.

Figure 5:
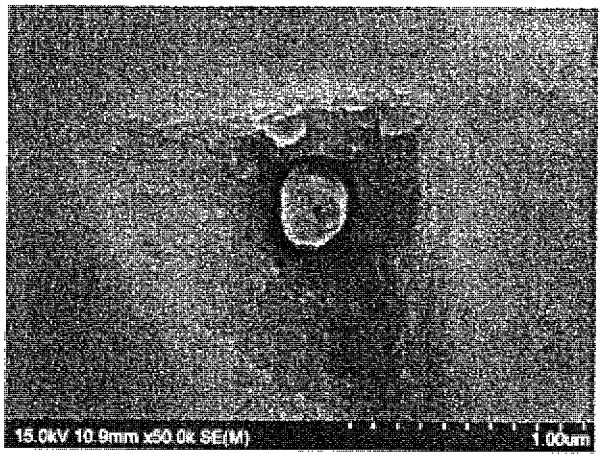
FIG. 5 is a view showing an SEM image of Ti—O—S particle of the present invention.

(b) Next, the hot rolling temperature (880 to 550° C.) is set to be lower than the typical manufacturing conditions (950 to 600° C.) of copper so that dislocation is introduced into copper to allow easy precipitation of sulfur (S). As a result, sulfur (S) is precipitated on the dislocation or is precipitated using titanium oxide ($TiO_2$) as crystal nuclei, and Ti—O—S particle, etc., is thereby formed as an example similarly to the molten copper (See the SEM image of FIG. 5 and the result of analysis of FIG. 6).

The sulfur in the copper is crystallized and precipitated by (a) and (b), and thus, a copper wire rod which satisfies the required softening temperature and conductivity is formed after a cold wire drawing process.

Next, the invention limits the following (1) to (4) as a limitation of the manufacturing conditions using the SCR continuous casting and rolling equipment.

(1) Limitation of Composition

In order to obtain a soft copper material having a conductivity of 98% IACS or more, a wire rod (a roughly drawn wire) is manufactured by using a dilute copper alloy material that includes pure copper (i.e., a base material) with inevitable impurity included therein, 3 to 12 mass ppm of sulfur, 2 to 30 mass ppm of oxygen and 4 to 55 mass ppm of Ti.

In order to obtain a soft copper material having a conductivity of 100% IACS or more, the wire rod is manufactured by using a dilute copper alloy material that includes pure copper with inevitable impurity included therein, 2 to 12 mass ppm of sulfur, 2 to 30 mass ppm of oxygen and 4 to 37 mass ppm of Ti.

In order to obtain a soft copper material having a conductivity of 102% IACS or more, the wire rod is manufactured by using a dilute copper alloy material that includes pure copper with inevitable impurity included therein, 3 to 12 mass ppm of sulfur, 2 to 30 mass ppm of oxygen and 4 to 25 mass ppm of Ti In the industrial production of pure copper, sulfur is generally introduced into copper during the manufacturing of electrolytic copper, and it is difficult to adjust sulfur to 3 mass ppm or less. The upper limit of the sulfur concentration for general-purpose electrolytic copper is 12 mass ppm.

Oxygen is controlled to 2 mass ppm or more since the softening temperature is less likely to decrease with less oxygen, as described above. On the other hand, since the surface flaw is likely to be generated during the hot rolling process when oxygen is excessive, oxygen is determined to be 30 mass ppm or less.

(2) Limitation of Dispersed Substance

It is desirable that the dispersed particles small in size and large in number are distributed. The reason thereof is that it functions as a precipitation site and it is thus required to be small in size and large in number.

Sulfur and titanium form a compound or an aggregate in the form of TiO, $TiO_2$, TiS or Ti—O—S, and the rest of Ti and S is present in the form of solid solution. The dilute copper alloy material is formed such that sizes of particle distributed in a crystal grain are 200 nm or less for TiO, 1000 nm or less for $TiO_2$, 200 nm or less for TiS and 300 nm or less for Ti—O—S.

However, since the particle size to be formed varies depending on holding time or a cooling status of the molten copper during the casting, it is also necessary to determine casting conditions.

(3) Limitation of Casting Conditions

As an example of forming a wire rod by the SCR continuous casting and rolling at a working ratio of 90% (30 mm) to 99.8% (5 mm), a method of manufacturing an 8 mm diameter wire rod at a working ratio of 99.3% is used.

(a) The casting temperature in the melting furnace is not less than 1100° C. and not more than 1320° C. It is determined to be not more than 1320° C. since there is a tendency that a blow hole is increased, a flaw is generated and a particle size is enlarged when the temperature of the molten copper is high. Although the reason why the temperature is not less than 1100° C. is that copper is likely to solidify and the manufacturing is not stable when less than 1100° C., the casting temperature is desirable at a temperature as low as possible.

(b) The hot-rolling temperature is not more than 880° C. at the initial roll and not less than 550° C. at the final roll.

Unlike the typical manufacturing conditions of pure copper, since the subject of the invention is to crystallize sulfur in the molten copper and to precipitate the sulfur during the hot rolling, it is preferable to determine the casting temperature and the hot-rolling temperature to (a) and (b) in order to further decrease a solid solubility limit as a driving force.

The typical hot-rolling temperature is not more than 950° C. at the initial roll and not less than 600° C. at the final roll, however, in order to further decrease the solid solubility limit, the temperature is determined to not more than 880° C. at the initial roll and not less than 550° C. at the final roll in the invention.

The reason why the temperature is not less than 550° C. is that there are many flaws on the wire rod at the lower temperature and it cannot be a finished product. The hot-rolling temperature is not more than 880° C. at the initial roll and not less than 550° C. at the final roll, and is preferably as low as possible. This makes the softening temperature (after being processed from 8 into 2.6 mm in diameter) considerably close to that of Cu (6N, softening temperature of 130° C.).

(c) It is possible to obtain such a dilute copper alloy wire or a sheet material that a wire rod with a diameter of 8 mm has a conductivity of not less than 98% IACS, not less than 100% IACS, or not less than 102% IACS, and a 2.6 mm diameter wire after cold rolling has a softening temperature of 130 to 148° C.

For the industrial use, 98% IACS or more is required for the soft copper wire manufactured from electrolyte copper with industrially usable purity, and the softening temperature of not more than 148° C. is required in light of the industrial value thereof. When Ti is not added, the softening temperature is 160 to 165° C. Since the softening temperature of Cu (6N) is 127 to 130° C., a limit value is determined to 130° C. from the obtained data. This slight difference is caused by inevitable impurity which is not present in Cu (6N).

Considering that oxygen-free copper has a conductivity of about 101.7% IACS and Cu (6N) has a conductivity of 102.8% IACS, it is desirable to have a conductivity close to Cu (6N) as possible.

(4) Limitation of Casting Conditions

A wire rod to be rolled may be stably manufactured such that after copper is melt in a shaft furnace, it is cast preferably under a reducing system controlled to have a gutter in a reduced-state, i.e., reductive gas (CO) atmosphere shield, etc., while controlling concentrations of sulfur, Ti and oxygen that are constituent elements of a dilute alloy. Mixture of copper oxide or a particle large in size deteriorates the quality.

Here, the reason why Ti is selected as an additive is as follows.

(a) Ti binds to sulfur in the molten copper and it is thus easy to form a compound.

(b) Compared with other added metal such as Zr, it is possible to process and the handling is easy.

(c) It is cheaper than Nb, etc.

(d) It is likely to be precipitated using oxide as a core.

As described above, the dilute copper alloy material of the invention can be used for a molten solder plating material (wire, plate, foil), an enameled wire, soft pure copper, high conductivity copper, reduction of annealing energy and a soft copper wire, and it is possible to obtain a practical dilute copper alloy material having high productivity and excellent in conductivity, softening temperature and surface quality.

In addition, a plating layer may be formed on a surface of the dilute copper alloy wire of the invention. A plating layer consisting mainly of, e.g., tin, nickel or silver is applicable, or, so-called Pb-free plating may be used therefor.

In addition, it is possible to use as a dilute copper alloy twisted wire which is formed by twisting plural dilute copper alloy wires of the invention.

In addition, it is possible to use as a cable having an insulating layer which is provided on a periphery of the dilute copper alloy wire or the dilute copper alloy twisted wire of the invention.

In addition, it is possible to use as a coaxial cable in which a central conductor is formed by twisting the plural dilute copper alloy wires of the invention together, an insulation cover is formed on an outer periphery of the central conductor, an outer conductor formed of copper or copper alloy is arranged on an outer periphery of the insulation cover and a jacket layer is provided on an outer periphery of the outer conductor.

In addition, it is possible to use as a composite cable in which plural coaxial cables are arranged in a shield layer and a sheath is provided on an outer periphery of the shield layer.

Although an example, in which a wire rod is formed by the SCR continuous casting and rolling and a soft material is formed by the hot rolling, has been explained in the above-mentioned embodiment, the invention may be configured to manufacture by twin-roll continuous casting and rolling and Properzi type continuous casting and rolling method.

EXAMPLES

Table 1 shows experimental conditions and results.

TABLE 1

| Examples | Oxygen conc. (mass ppm) | S conc. (mass ppm) | Ti conc. (mass ppm) | 2.6 mm dia. semi-softening temperature (° C.) | 2.6 mm dia. conductivity of soft material (% IACS) | Evaluation of dispersed particle size | Overall evaluation |
|---|---|---|---|---|---|---|---|
| Comparative Example 1 (small continuous casting machine) | 1 to less than 2 | 5 | 0 | 215 X | 101.7 | ○ | X |
| | 1 to less than 2 | 5 | 7 | 168 X | 101.5 | ○ | X |
| | 1 to less than 2 | 5 | 13 | 160 X | 100.9 | ○ | X |
| | 1 to less than 2 | 5 | 15 | 173 X | 100.5 | ○ | X |
| | 1 to less than 2 | 5 | 18 | 190 X | 99.6 | ○ | X |
| Comparative Example 2 (SCR) | 7-8 | 3 | 0 | 164 X | 102.2 | ○ | X |
| | 7-8 | 5 | 2 | 157 X | 102.1 | ○ | X |
| Example 1 (SCR) | 7-8 | 5 | 4 | 148 ○ | 102.1 | ○ | ○ |
| | 7-8 | 5 | 10 | 135 ○ | 102.2 | ○ | ○ |
| | 7-8 | 5 | 13 | 134 ○ | 102.4 | ○ | ○ |
| | 7-8 | 5 | 20 | 130 ○ | 102.2 | ○ | ○ |
| | 7-8 | 5 | 25 | 132 ○ | 102.0 | ○ | ○ |
| | 7-8 | 5 | 37 | 134 ○ | 101.1 | ○ | ○ |
| | 7-8 | 5 | 40 | 135 ○ | 99.6 | ○ | ○ |
| | 7-8 | 5 | 55 | 148 ○ | 98.2 | ○ | ○ |
| Comparative Example 3 (SCR) | 7-8 | 5 | 60 | 155 X | 97.7 | X Poor surface quality | X |
| Example 2 (SCR) | Difficult to control stability at less than 2 | 5 | 13 | 145 ○ | 102.1 | ○ | Δ |
| | 2-3 | 5 | 11 | 133 ○ | 102.2 | ○ | ○ |
| | 3 | 5 | 12 | 133 ○ | 102.2 | ○ | ○ |
| | 30 | 5 | 10 | 134 ○ | 102.0 | ○ | ○ |
| Comparative Example 4 (SCR) | 40 | 5 | 14 | 134 ○ | 101.8 | X Poor surface quality | X |
| Example 3 (SCR) | 7-8 | 2 | 4 | 134 ○ | 102.2 | ○ | ○ |
| | 7-8 | 10 | 13 | 135 ○ | 102.3 | ○ | ○ |
| | 7-8 | 12 | 14 | 136 ○ | 102.2 | ○ | ○ |
| | 7-8 | 11 | 19 | 133 ○ | 102.4 | ○ | ○ |
| | 7-8 | 12 | 20 | 133 ○ | 102.4 | ○ | ○ |
| Comparative Example 5 (SCR) | 7-8 | 18 | 13 | 162 X | 101.5 | ○ | X |
| Comparative Example 6 (Cu (6N)) | | | | 127-130 ○ | 102.8 | Null | — |

Firstly, in Example 1-3 and Comparative Examples 1-6, an 8 mm diameter copper wire (a wire rod) with a working ratio of 99.3% was made at respective concentrations of oxygen, sulfur and Ti shown in Table 1. Then, the wire rod was cold drawn into a 2.6 mm diameter wire. For the 2.6 mm diameter drawn wire, semi-softening temperature and conductivity were measured, and for the 8 mm diameter copper wire, dispersed particle size was evaluated.

The oxygen concentration was measured by an oxygen analyzer (Leco oxygen analyzer (Leco: registered trademark). Each concentration of sulfur and Ti is a result of analysis by an IPC emission spectrophotometer.

After holding for one hour for each temperature of 400° C. or less, water quenching and a tensile test were carried out, and the measurement result of the semi-softening temperature in the 2.6 mm diameter was obtained. It was obtained by using the result of the tensile test at a room temperature and the result of the tensile test of the soft copper wire which was heat-treated in an oil bath at 400° C. or for one hour. The temperature corresponding to strength which indicates a half value of tensile strength difference was defined as a semi-softening temperature and was calculated.

It is desirable that the dispersed particles small in size and large in number are distributed. The reason thereof is that it functions as a precipitation site and it is required to be small in size and large in number. In other words, it is judged as "passed" when 90% or more of dispersed particles have a diameter of 500 nm or less.

Comparative Example 1

In Table 1, Comparative Example 1 is a copper wire having a diameter of 8 mm which was experimentally formed under Ar atmosphere in the experimental laboratory and to which 0 to 18 mass ppm of Ti was added.

In contrast to the case that the semi-softening temperature without adding Ti is 215° C., the semi-softening temperature was minimized to 160° C. by adding 13 mass ppm of Ti and was increased by adding 15, 18 mass ppm of Ti, thus, the desired semi-softening temperature of 148° C. or less was not obtained. Although the industrially demanded conductivity which is not less than 98% IACS was satisfied, the overall evaluation was X (not good).

Comparative Example 2

Next, the oxygen concentration was adjusted to 7 to 8 mass ppm, and then, an 8 mm diameter copper wire (a wire rod) was experimentally formed using the SCR continuous casting and rolling method.

Among the materials experimentally formed using the SCR continuous casting and rolling method, Comparative Example 2 has less Ti concentration (0.2 mass ppm). Although the conductivity is not less than 102% IACS, the semi-softening temperature is 164 or 157° C. which does not satisfy the demanded temperature of 148° C. or less, hence, the overall evaluation is X (not good).

Example 1

Example 1 according to the invention is an experimental material which has substantially constant oxygen and sulfur concentrations (7 to 8 mass ppm and 5 mass ppm, respectively) but has different Ti concentrations (4 to 55 mass ppm).

The Ti concentration range of 4 to 55 mass ppm is satisfactory because the softening temperature is 148° C. or less, the conductivity is not less than 98% IACS or not less than 102% IACS, and the dispersed particle size is not more than 500 nm in 90% or more of particles. In addition, the surface of the wire rod is also fine, thus, all materials satisfy the product performances (the overall evaluation is 0 (good)).

Here, the conductivity of not less than 100% IACS is satisfied when the Ti concentration is 4 to 37 mass ppm, and not less than 102% IACS is satisfied when the Ti concentration is 4 to 25 mass ppm. The conductivity of 102.4% IACS which is the maximum value was indicated when the Ti concentration is 13 mass ppm, and the conductivity at around this concentration was a slightly low value. This is because, when the Ti is 13 mass ppm, sulfur content in copper is trapped as a compound, and thus, the conductivity close to that of pure copper (6N) is indicated.

Therefore, it is possible to satisfy both of the semi-softening temperature and the conductivity by increasing the oxygen concentration and adding Ti.

Comparative Example 3

Comparative Example 3 is an experimental material in which the Ti concentration is increased to 60 mass ppm. Comparative Example 3 satisfies the demanded conductivity, however, the semi-softening temperature is 148° C. or more, which does not satisfy the product performance. Furthermore, there were many surface flaws on the wire rod, hence, it was difficult to treat as a commercial product. Therefore, the amount of Ti added should be less than 60 mass ppm.

Example 2

Example 2 according to the invention is an experimental material for examining the affect of the oxygen concentration by changing the oxygen concentration while the sulfur concentration is 5 mass ppm and the Ti concentration is 13 to 10 mass ppm.

The experimental materials having largely different oxygen concentrations from 2 or less to 30 mass ppm were made. However, since it is difficult to produce and the stable manufacturing is not possible when oxygen is less than 2 mass ppm, the overall evaluation is Δ. In addition, it was found that the semi-softening temperature and the conductivity are both satisfied even when the oxygen concentration is increased to 30 mass ppm.

Comparative Example 4

As shown by Comparative Example 4, when oxygen is 40 mass ppm, there were many flaws on the surface of the wire rod, and it could not be a commercial product.

Therefore, by adjusting the oxygen concentration so as to fall within a range of 2 to 30 mass ppm, it is possible to satisfy all characteristics of the semi-softening temperature, conductivity of 102% IACS or more and the dispersed particle size, and in addition, the surface of the wire rod is fine, thus, any of them can satisfy the product performance.

Example 3

Example 3 according to the invention is an example of an experimental material in which each oxygen concentration is relatively close to the Ti concentration and the sulfur concentration is changed from 4 to 20 mass ppm. In Example 3, it was not possible to realize the experimental material having less than 2 mass ppm of sulfur from a viewpoint of raw material, however, it is possible to satisfy both of the semi-softening temperature and the conductivity by controlling the concentrations of Ti and sulfur.

Comparative Example 5

Comparative Example 5, in which the sulfur concentration is 18 mass ppm and Ti concentration is 13 mass ppm, has a high semi-softening temperature of 162° C. and could not satisfy requisite characteristics. In addition, the surface quality of the wire rod is specifically poor, and it was thus difficult to treat as a commercial product.

As described above, it was found that all characteristics which are the semi-softening temperature, 102% IACS or more of conductivity and the dispersed particle size are satisfied when the sulfur concentration is 2 to 12 mass ppm, the surface of the wire rod is also fine and all product performances are satisfied.

Comparative Example 6

In Comparative Example 6, as shown in the result of the examination using Cu (6N), the semi-softening temperature was 127 to 130° C., the conductivity was 102.8% IACS and particles having 500 nm or less in dispersed particle size were not observed at all.

TABLE 2

| Examples | Molten copper temperature (° C.) | Oxygen conc. (mass ppm) | S conc. (mass ppm) | Ti conc. (mass ppm) | hot-rolling temperature (° C.) Initial-Final | 2.6 mm dia. semi-softening temperature (° C.) | 2.6 mm dia. conductivity of soft material (% IACS) | WR surface quality | Evaluation of dispersed particle size | Overall evaluation |
|---|---|---|---|---|---|---|---|---|---|---|
| Comparative | 1350 | 15 | 7 | 13 | 950-600 | 148 | 101.7 | X | X | X |
| Example 7 | 1330 | 16 | 6 | 11 | 950-600 | 147 | 101.2 | X | X | X |
| Example 4 | 1320 | 15 | 5 | 13 | 880-550 | 143 | 102.1 | ○ | ○ | ○ |
| | 1300 | 16 | 6 | 13 | 880-550 | 141 | 102.3 | ○ | ○ | ○ |
| | 1250 | 15 | 6 | 14 | 880-550 | 138 | 102.1 | ○ | ○ | ○ |
| | 1200 | 15 | 6 | 14 | 880-550 | 135 | 102.1 | ○ | ○ | ○ |
| Comparative Example 8 | 1100 | 12 | 5 | 12 | 880-550 | 135 | 102.1 | X | ○ | X |
| Comparative Example 9 | 1300 | 13 | 6 | 13 | 950-600 | 147 | 101.5 | ○ | X | X |
| Comparative Example 10 | 1350 | 14 | 6 | 12 | 880-550 | 149 | 101.5 | X | X | X |

Table 2 shows a molten copper temperature and a rolling temperature as the manufacturing conditions.

Comparative Example 7

Comparative Example 7 is an 8 mm diameter wire rod experimentally formed at the molten copper temperature of 1330 to 1350° C., which is slightly high, and at the rolling temperature of 950 to 600° C.

Although Comparative Example 7 satisfies the semi-softening temperature and the conductivity, there are particles having about 1000 nm in dispersed particle size and particle having 500 nm or more exceed 10%. Therefore, it is evaluated as inapplicable.

Example 4

Example 4 according to the invention is a 8 mm diameter wire rod experimentally formed at the molten copper temperature of 1200 to 1320° C. and at the rolling temperature of 880 to 550° C., which is slightly low. The surface quality of the wire and the dispersed particle size of Example 4 were satisfactory and the overall evaluation was 0 (good).

Comparative Example 8

Comparative Example 8 is an 8 mm diameter wire rod experimentally formed at the molten copper temperature of 1100° C. and at the rolling temperature of 880 to 550° C., which is slightly low. Since the molten copper temperature is low in Comparative Example 8, there were many surface flaws on the rod wire and was not suitable for the commercial product. This is because the flaws are likely to be generated at the time of rolling since the molten copper temperature is low.

Comparative Example 9

Comparative Example 9 is an 8 mm diameter wire rod experimentally formed at the molten copper temperature of 1300° C. and at the rolling temperature of 950 to 600° C., which is slightly high. In Comparative Example 9, the surface quality of the wire rod is satisfactory since the hot-rolling temperature is high, however, the dispersed particles large in size are present and the overall evaluation is X (not good).

Comparative Example 10

Comparative Example 10 is an 8 mm diameter wire rod experimentally formed at the molten copper temperature of 1350° C. and at the rolling temperature of 880 to 550° C., which is slightly low. In Comparative Example 10, the large dispersed particles are present since the molten copper temperature is high, and the overall evaluation is X (not good).

Although the invention has been described with respect to the specific embodiment for complete and clear disclosure, the appended claims are not to be therefore limited but are to be construed as embodying all modifications and alternative constructions that may occur to one skilled in the art which fairly fall within the basic teaching herein set forth.

What is claimed is:

1. A dilute copper alloy material, consisting of:

based on a total mass of the dilute copper alloy material, 3 to 12 mass ppm of sulfur, 7 to 30 mass ppm of oxygen, 4 to 40 mass ppm of titanium, and a balance consisting of pure copper and inevitable impurity, wherein a conductivity is not less than 102% International Annealed Copper Standard (IACS) and a softening temperature is 130° C. to 148° C., and wherein a part of the sulfur and the titanium forms a compound or an aggregate of TiO, $TiO_2$, TiS and Ti—O—S, and an other part of the sulfur and the titanium forms a solid solution, wherein the compound or the aggregate of TiO, $TiO_2$, TiS and Ti—O—S distributed in a crystal grain of the dilute copper alloy material are not more than 200 nm, not more than 1000 nm, not more than 200 nm and not more than 300 nm, respectively, in particle size thereof, and not less than 90% of particles distributed in a crystal grain of the dilute copper alloy material are 500 nm or less in particle size.

2. A dilute copper alloy wire, comprising:

the dilute copper alloy material according to claim 1;

a conductivity not less than 102% IACS; and a softening temperature of 130° C. to 148° C. when a diameter thereof is 2.6 mm.

3. A dilute copper alloy wire, comprising:

a dilute copper alloy material consisting of, based on a total mass of said dilute copper alloy material, 3 to 12 mass ppm of sulfur, 7 to 30 mass ppm of oxygen, 4 to 37 mass ppm of titanium, and a balance consisting of pure copper and inevitable impurity;

a conductivity not less than 102% International Annealed Copper Standard (IACS); and a softening temperature of 130° C. to 148° C. when a diameter thereof is 2.6 mm, wherein a part of the sulfur and the titanium forms a compound or an aggregate of TiO, $TiO_2$, TiS and Ti—O—S, and an other part of the sulfur and the titanium forms a solid solution, wherein the compound or the aggregate of TiO, $TiO_2$, TiS and Ti—O—S distributed in a crystal grain of the dilute copper alloy material are not more than 200 nm, not more than 1000 nm, not more than 200 nm and not more than 300 nm, respectively, in particle size thereof, and not less than 90% of particles distributed in a crystal grain of the dilute copper alloy material are 500 nm or less in particle size.

4. A dilute copper alloy wire, comprising:

a dilute copper alloy material consisting of, based on a total mass of said dilute copper alloy material, 3 to 12 mass ppm of sulfur, 7 to 30 mass ppm of oxygen, 4 to 25 mass ppm of titanium, and a balance consisting of pure copper and inevitable impurity;

a conductivity not less than 102% International Annealed Copper Standard (IACS); and a softening temperature of 130° C. to 148° C. when a diameter thereof is 2.6 mm, wherein a part of the sulfur and the titanium forms a compound or an aggregate of TiO, $TiO_2$, TiS and Ti—O—S, and an other part of the sulfur and the titanium forms a solid solution, wherein the compound or the aggregate of TiO, $TiO_2$, TiS and Ti—O—S distributed in a crystal grain of the dilute copper alloy material are not more than 200 nm, not more than 1000 nm, not more than 200 nm and not more than 300 nm, respectively, in particle size thereof, and not less than 90% of particles distributed in a crystal grain of the dilute copper alloy material are 500 nm or less in particle size.

5. The dilute copper alloy wire according to claim 2, further comprising a plating layer formed on a surface of the dilute copper alloy wire.

6. A dilute copper alloy twisted wire, comprising:

a plurality of the dilute copper alloy wires according to claim 2 twisted together.

7. A cable, comprising:

the dilute copper alloy wire according to claim 2, and an insulating layer formed on the dilute copper alloy wire.

8. A coaxial cable, comprising:

a central conductor comprising a plurality of the dilute copper alloy wires according to claim 2 twisted together;

an insulation cover on an outer periphery of the central conductor;

an outer conductor comprising copper or copper alloy on an outer periphery of the insulation cover; and a jacket layer on an outer periphery of the outer conductor.

9. A composite cable, comprising:

a plurality of the cables according to claim 7 arranged in a shield layer; and a sheath on an outer periphery of the shield layer.

10. A method of manufacturing a dilute copper alloy wire, comprising:

forming molten metal by melting the dilute copper alloy material according to claim 1 by SCR continuous casting and rolling at a casting temperature of not less than 1100° C. and not more than 1320° C.;

making a wire rod at a working ratio of 90% (corresponding to 30 mm in diameter) to 99.8% (corresponding to 5 mm in diameter); and making a dilute copper alloy wire by hot-rolling the wire rod.

11. The method according to claim 10, wherein said hot-rolling is conducted such that temperature is not more than 880° C. at an initial roll and not less than 550° C. at a final roll.

12. The method according to claim 10, wherein copper as a base of the dilute copper alloy material is molten in a shaft furnace, and is subsequently cast and rolled under a reducing system comprising a reductive gas atmosphere shield while controlling concentrations of sulfur, titanium and oxygen in the dilute copper alloy material.

13. A method of manufacturing a dilute copper alloy member, comprising:

forming a wire rod from the dilute copper alloy material according to claim 1 by twin-roll continuous casting and rolling and Properzi type continuous casting and rolling at a casting temperature of not less than 1100° C. nor more than 1320° C.; and hot-rolling the wire rod, wherein said hot-rolling is conducted such that temperature is not more than 880° C. at an initial roll and not less than 550° C. at a final roll.

14. The method according to claim 13, wherein copper as a base of the dilute copper alloy member is molten in a shaft furnace, and is subsequently cast and rolled under a reducing system comprising a gutter in a reduced-state and a reductive gas atmosphere shield while controlling concentrations of sulfur, titanium and oxygen in the dilute copper alloy material.

15. A solder-plated composite wire for a solar cell manufactured by using the dilute copper alloy wire according to claim 2.

16. The dilute copper alloy wire according to claim 5, wherein the plating layer comprises tin, nickel or silver.

* * * * *